US010157567B2

(12) United States Patent
Lee et al.

(10) Patent No.: US 10,157,567 B2
(45) Date of Patent: Dec. 18, 2018

(54) DISPLAY APPARATUS AND A METHOD OF OPERATING THE SAME

(71) Applicant: SAMSUNG DISPLAY CO., LTD., Yongin-si, Gyeonggi-do (KR)

(72) Inventors: Chang-Soo Lee, Suwon-si (KR); Kookhyun Choi, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/476,133

(22) Filed: Mar. 31, 2017

(65) Prior Publication Data

US 2018/0012533 A1 Jan. 11, 2018

(30) Foreign Application Priority Data

Jul. 11, 2016 (KR) ..... 10-2016-0087731

(51) Int. Cl.
*G09G 3/20* (2006.01)

(52) U.S. Cl.
CPC ... *G09G 3/2092* (2013.01); *G09G 2310/0267* (2013.01); *G09G 2310/0286* (2013.01); *G09G 2310/0289* (2013.01); *G09G 2310/08* (2013.01); *G09G 2320/041* (2013.01); *G09G 2330/028* (2013.01)

(58) Field of Classification Search
CPC ..... G09G 3/2092; G09G 2310/0289; G09G 2310/08; G09G 2320/041
See application file for complete search history.

(56) References Cited

U.S. PATENT DOCUMENTS 9,984,641 B2 * 5/2018 Kang ..... G09G 3/3677
2002/0047557 A1 * 4/2002 Kim ..... G09G 3/20 315/169.3
2008/0309609 A1 12/2008 Feng
2010/0238156 A1 * 9/2010 Iwamoto ..... G09G 3/3648 345/213
2011/0227505 A1 * 9/2011 Park ..... H05B 33/0896 315/297
2011/0254871 A1 * 10/2011 Yoo ..... G09G 3/3233 345/690

(Continued)

FOREIGN PATENT DOCUMENTS

KR 1020050095443 9/2005

*Primary Examiner* — Jonathan R Horner
(74) *Attorney, Agent, or Firm* — F. Chau & Associates, LLC

(57) ABSTRACT

A display apparatus includes a display panel, a gate driver, and a gate driving control circuit. The gate driver is connected to the display panel, and generates gate signals for driving the display panel using a gate clock signal. The gate driving control circuit generates the gate clock signal using a gate on voltage and a gate off voltage, determines whether an operation environment is an abnormal temperature environment by comparing a first feedback gate signal with a second feedback gate signal, and adjusts a voltage level of the gate clock signal in the abnormal temperature environment. The first feedback gate signal is retrieved from the display panel while a first frame image is displayed on the display panel. The second feedback gate signal is retrieved from the display panel while a second frame image subsequent to the first frame image is displayed on the display panel.

20 Claims, 11 Drawing Sheets

(56) References Cited

U.S. PATENT DOCUMENTS

| | | | | |
|---|---|---|---|---|
| 2012/0075280 | A1* | 3/2012 | Liu | G09G 3/3677 345/212 |
| 2014/0118324 | A1* | 5/2014 | Chan | G09G 3/3677 345/212 |
| 2014/0340381 | A1* | 11/2014 | Kim | G09G 3/3655 345/212 |
| 2016/0365051 | A1* | 12/2016 | Jung | G09G 3/3406 |
| 2017/0162165 | A1* | 6/2017 | Xiong | G09G 3/3677 |

* cited by examiner

DISPLAY APPARATUS AND A METHOD OF OPERATING THE SAME

CROSS-REFERENCE TO RELATED APPLICATION

This application claims priority under 35 U.S.C. § 119 to Korean Patent Application No. 10-2016-0087731, filed on Jul. 11, 2016 in the Korean Intellectual Property Office (KIPO), the disclosure of which is incorporated by reference herein in its entirety.

TECHNICAL FIELD

Exemplary embodiments of the inventive concept relate to displaying images, and more particularly, to display apparatuses and methods of operating the display apparatuses.

DISCUSSION OF RELATED ART

Types of flat panel displays (FPD), which have been widely used in recent years, may include, but are not limited to, liquid crystal displays (LCD), plasma display panels (PDP), and organic light emitting displays (OLED).

A display apparatus includes a display panel in which a plurality of pixels are connected to gate lines and data lines crossing the gate lines, which are formed on the display panel. A gate driver circuit is configured for outputting gate signals to the gate lines and a data driver circuit is configured for outputting data signals to the data lines. Temperature variation may cause deterioration in display quality of the display panel.

SUMMARY

According to an exemplary embodiment of the inventive concept, a display apparatus includes a display panel, a gate driver, and a gate driving control circuit. The gate driver is connected to the display panel, and generates a plurality of gate signals for driving the display panel using a gate clock signal. The gate driving control circuit generates the gate clock signal using a gate on voltage and a gate off voltage, determines whether an operation environment is a normal environment or an abnormal temperature environment by comparing a first feedback gate signal with a second feedback gate signal, and adjusts a voltage level of the gate clock signal when it is determined that the operation environment is the abnormal temperature environment. The first feedback gate signal is retrieved from the display panel while a first frame image is displayed on the display panel. The second feedback gate signal is retrieved from the display panel while a second frame image subsequent to the first frame image is displayed on the display panel.

In an exemplary embodiment of the inventive concept, the gate driving control circuit may compare a first voltage value with a second voltage value, and may determine that the operation environment is the abnormal temperature environment when a difference between the first and second voltage values is greater than a reference value. The first voltage value may be a voltage difference between a high level and a low level of the first feedback gate signal, and the second voltage value may be a voltage difference between a high level and a low level of the second feedback gate signal.

In an exemplary embodiment of the inventive concept, the gate driving control circuit may determine that the abnormal temperature environment is a low temperature environment when the first voltage value is greater than the second voltage value, and may increase a high voltage level of the gate clock signal in the low temperature environment.

In an exemplary embodiment of the inventive concept, in the low temperature environment, the gate driving control circuit may increase the high voltage level of the gate clock signal by the difference between the first and second voltage values.

In an exemplary embodiment of the inventive concept, in the low temperature environment, the gate driving control circuit may increase a level of the gate on voltage by the difference between the first and second voltage values, and may increase the high voltage level of the gate clock signal using the increased gate on voltage.

In an exemplary embodiment of the inventive concept, the gate driving control circuit may determine that the abnormal temperature environment is a high temperature environment when the first voltage value is less than or equal to the second voltage value, and may decrease a high voltage level of the gate clock signal in the high temperature environment.

In an exemplary embodiment of the inventive concept, the gate driving control circuit may include a detector, a comparator, and a gate clock generator. The detector may detect the first and second voltage values from the first and second feedback gate signals, respectively, and may store the first and second voltage values. The comparator may generate a first comparison signal by comparing the difference between the first and second voltage values with the reference value, and may generate a second comparison signal by comparing the first voltage value with the second voltage value. The gate clock generator may generate the gate clock signal using the gate on voltage and the gate off voltage, and may adjust a high voltage level of the gate clock signal when it is determined, using the first and second comparison signals, that the operation environment is the abnormal temperature environment. The detector, the comparator, and the gate clock generator may be included in a single chip.

In an exemplary embodiment of the inventive concept, the gate driving control circuit may include a power management integrated circuit (PMIC) chip and a gate clock generation integrated circuit (GCIC) chip. The PMIC chip may generate the gate on voltage and the gate off voltage. The GCIC chip may generate the gate clock signal using the gate on voltage and the gate off voltage. The PMIC chip may include a detector, a comparator, and a gate voltage level controller. The detector may detect the first and second voltage values from the first and second feedback gate signals, respectively, and may store the first and second voltage values. The comparator may generate a first comparison signal by comparing the difference between the first and second voltage values with the reference value, and may generate a second comparison signal by comparing the first voltage value with the second voltage value. The gate voltage level controller may generate the gate on voltage and the gate off voltage, and may adjust a level of the gate on voltage when it is determined, using the first and second comparison signals, that the operation environment is the abnormal temperature environment.

In an exemplary embodiment of the inventive concept, the gate driving control circuit may include a PMIC chip and a GCIC chip. The PMIC chip may generate the gate on voltage and the gate off voltage. The GCIC chip may generate the gate clock signal using the gate on voltage and the gate off voltage. The GCIC chip may include a detector, a comparator, and a gate clock generator. The detector may detect the first and second voltage values from the first and second feedback gate signals, respectively, and may store the first and second voltage values. The comparator may generate a first comparison signal by comparing the difference between the first and second voltage values with the reference value, and may generate a second comparison signal by comparing the first voltage value with the second voltage value. The gate clock generator may generate the gate clock signal using the gate on voltage and the gate off voltage, and may adjust a high voltage level of the gate clock signal when it is determined, using the first and second comparison signals, that the operation environment is the abnormal temperature environment.

In an exemplary embodiment of the inventive concept, the display apparatus may further include a plurality of gate lines connecting the display panel with the gate driver. The first and second feedback gate signals may be retrieved from one of the plurality of gate lines.

In an exemplary embodiment of the inventive concept, the first and second feedback gate signals may be retrieved from a first gate line among the plurality of gate lines, and among the plurality of gate lines, the first gate line may be disposed closest to the gate driving control circuit.

In an exemplary embodiment of the inventive concept, the display apparatus may further include a feedback line connecting the gate driving control circuit with a first gate line among the plurality of gate lines. The first and second feedback gate signals may be retrieved from the first gate line.

In an exemplary embodiment of the inventive concept, the display apparatus may further include a plurality of gate lines and a dummy gate line connecting the display panel with the gate driver. The first and second feedback gate signals may be retrieved from the dummy gate line.

In an exemplary embodiment of the inventive concept, the first and second frame images may be two consecutive frame images displayed on the display panel.

In an exemplary embodiment of the inventive concept, the display panel may include a display region including a plurality of pixels and a peripheral region surrounding the display region. The gate driver may be disposed on the peripheral region of the display panel.

According to an exemplary embodiment of the inventive concept, in a method of operating a display apparatus including a display panel, a gate clock signal is generated using a gate on voltage and a gate off voltage. A plurality of gate signals for driving the display panel is generated using the gate clock signal. It is determined whether an operation environment is a normal environment or an abnormal temperature environment by comparing a first feedback gate signal with a second feedback gate signal. The first feedback gate signal is retrieved from the display panel while a first frame image is displayed on the display panel. The second feedback gate signal is retrieved from the display panel while a second frame image subsequent to the first frame image is displayed on the display panel. A voltage level of the gate clock signal is adjusted when it is determined that the operation environment is the abnormal temperature environment.

In an exemplary embodiment of the inventive concept, in determining whether the operation environment is the normal environment or the abnormal temperature environment, a first voltage value may be compared with a second voltage value. The first voltage value may be a voltage difference between a high level and a low level of the first feedback gate signal. The second voltage value may be a voltage difference between a high level and a low level of the second feedback gate signal. It may be determined that the operation environment is the abnormal temperature environment when a difference between the first and second voltage values is greater than a reference value.

In an exemplary embodiment of the inventive concept, in determining that the operation environment is the abnormal temperature environment, it may be determined that the abnormal temperature environment is a low temperature environment when the first voltage value is greater than the second voltage value. It may be determined that the abnormal temperature environment is a high temperature environment when the first voltage value is less than or equal to the second voltage value.

In an exemplary embodiment of the inventive concept, in adjusting the voltage level of the gate clock signal, a high voltage level of the gate clock signal may be increased in the low temperature environment. The high voltage level of the gate clock signal may be decreased in the high temperature environment.

In an exemplary embodiment of the inventive concept, in the low temperature environment, the high voltage level of the gate clock signal may be increased by the difference between the first and second voltage values.

According to an exemplary embodiment of the inventive concept, a display apparatus includes a display panel, a gate driver, a gate driving control circuit, and a feedback line. The gate driver is connected to the display panel, and configured to provide a plurality of gate signals for driving the display panel to a plurality of gate lines using a gate clock signal. The gate driving control circuit is connected to the gate driver and configured to provide the gate clock signal to the gate driver. The feedback line is connected between the gate driving control circuit and a first gate line among the plurality of gate lines, and configured to provide a first feedback gate signal and a second feedback gate signal from the first gate line to the gate driving control circuit. The first feedback gate signal is retrieved from the first gate line while a first frame image is displayed on the display panel. The second feedback gate signal is retrieved from the first gate line while a second frame image subsequent to the first frame image is displayed on the display panel. The gate driving control circuit is configured to adjust a voltage level of the gate clock signal depending on a comparison result of the first and second feedback gate signals.

BRIEF DESCRIPTION OF THE DRAWINGS

The above and other features of the inventive concept will be more clearly understood by describing in detail exemplary embodiments thereof with reference to the accompanying drawings.

DETAILED DESCRIPTION OF THE EMBODIMENTS

Figure 1:
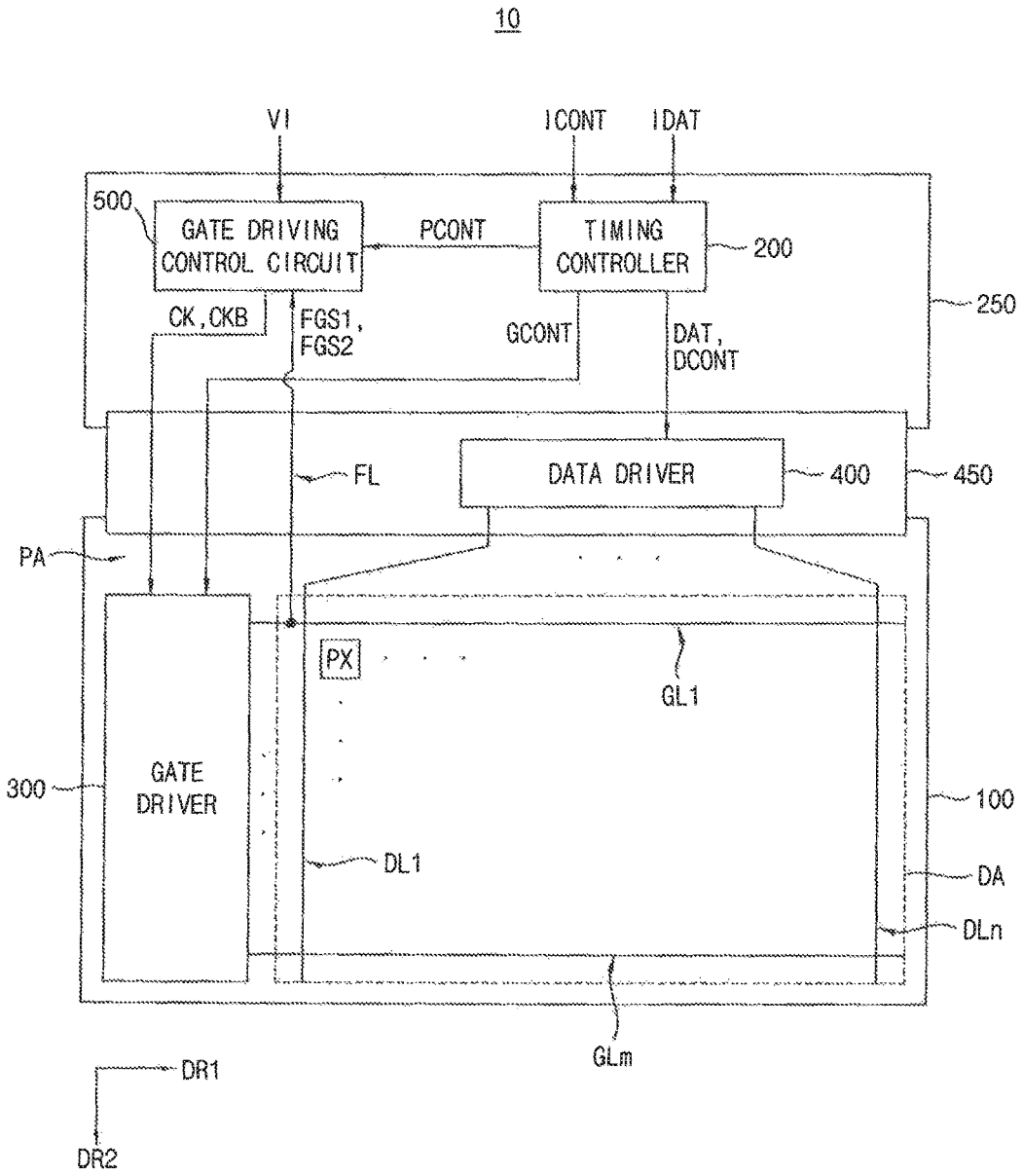
FIG. 1 is a block diagram illustrating a display apparatus according to an exemplary embodiment of the inventive concept.

Exemplary embodiments of the inventive concept will be described more fully hereinafter with reference to the accompanying drawings. Like reference numerals may refer to like elements throughout this application.

Exemplary embodiments of the inventive concept provide a display apparatus capable of preventing deterioration of display quality due to temperature change.

Exemplary embodiments of the inventive concept also provide a method of operating the above-mentioned display apparatus.

FIG. 1 is a block diagram illustrating a display apparatus according to an exemplary embodiment of the inventive concept.

Referring to FIG. 1, a display apparatus 10 includes a display panel 100, a timing controller 200, a gate driver 300, a data driver 400, and a gate driving control circuit 500. The display apparatus 10 may further include a printed circuit board (PCB) 250 and a flexible PCB (FPCB) 450.

The display panel 100 operates (e.g., displays an image) based on output image data DAT. The display panel 100 is connected to a plurality of gate lines GL1~GLm and a plurality of data lines DL1~DLn. The gate lines GL1~GLm may extend in a first direction DR1, and the data lines DL1~DLn may extend in a second direction DR2 crossing (e.g., substantially perpendicular to) the first direction DR1.

The display panel 100 may include a display region DA and a peripheral region PA. The display region DA may include a plurality of pixels PX that are arranged in a matrix form. Each of the pixels PX may be electrically connected to one of the gate lines GL1~GLm and one of the data lines DL1~DLn. The peripheral region PA may surround the display region DA.

The timing controller 200 controls operations of the display panel 100, the gate driver 300, the data driver 400, and the gate driving control circuit 500. The timing controller 200 receives input image data IDAT and an input control signal ICONT from an external device (e.g., a host or a graphic processor). The input image data IDAT may include a plurality of pixel data for the plurality of pixels PX. The input control signal ICONT may include a master clock signal, a data enable signal, a vertical synchronization signal, a horizontal synchronization signal, etc.

The timing controller 200 generates the output image data DAT based on the input image data IDAT. For example, the timing controller 200 may selectively perform an image quality compensation, a spot compensation, an adaptive color correction (ACC), and/or a dynamic capacitance compensation (DCC) on the input image data IDAT to generate the output image data DAT. The timing controller 200 generates a first control signal GCONT, a second control signal DCONT, and a third control signal PCONT based on the input control signal ICONT. For example, the first control signal GCONT may include a vertical start signal, etc. The second control signal DCONT may include a horizontal start signal, a data clock signal, a polarity control signal, a data load signal, etc. The third control signal PCONT may include a gate clock control signal, etc.

The gate driver 300 is connected to the display panel 100 through the gate lines GL1~GLm. The gate driver 300 generates a plurality of gate signals for driving the display panel 100 based on the first control signal GCONT, a gate clock signal CK, and an inverted gate clock signal CKB. For example, the gate driver 300 may sequentially provide the plurality of gate signals to the display panel 100 through the gate lines GL1~GLm. For example, the gate driver 300 may include a plurality of shift registers.

The data driver 400 is connected to the display panel 100 through the data lines DL1~DLn. The data driver 400 generates a plurality of data voltages (e.g., analog voltages) for driving the display panel 100 based on the output image data DAT (e.g., digital data) and the second control signal DCONT. For example, the data driver 400 may sequentially provide the plurality of data voltages to a plurality of lines (e.g., horizontal lines) in the display panel 100 through the data lines DL1~DLn. For example, the data driver 400 may include a shift register, a data latch, an analog-to-digital converter, and an output buffer.

The gate driving control circuit 500 generates a gate on voltage and a gate off voltage based on an operating voltage VI received from an external circuit (e.g., a power supply or a voltage generator) and the third control signal PCONT. The gate one voltage and the gate off voltage will be described further below. The gate driving control circuit 500 generates the gate clock signal CK and the inverted gate clock signal CKB based on the gate on voltage and the gate off voltage. The inverted gate clock signal CKB may be an inversion of the gate clock signal CK, and may have a phase opposite to that of the gate clock signal CK.

In addition, the gate driving control circuit 500 determines whether an operation environment of the display apparatus 10 is a normal environment or an abnormal temperature environment by comparing a first feedback gate signal FGS1 with a second feedback gate signal FGS2, and adjusts a voltage level of the gate clock signal CK when it is determined that the operation environment is the abnormal temperature environment. The first and second feedback gate signals FGS1 and FGS2 are retrieved or returned from the display panel 100 through a feedback line FL. For example, the first feedback gate signal FGS1 is retrieved from the display panel 100 while a first frame image is displayed on the display panel 100. The second feedback gate signal FGS2 is retrieved from the display panel 100 while a second frame image, subsequent to the first frame image, is displayed on the display panel 100.

According to exemplary embodiments of the inventive concept, the first and second feedback gate signals FGS1 and FGS2 may both be retrieved from one of the plurality of gate lines GL1~GLm (e.g., from the same gate line). For example, the feedback line FL may be connected to a first gate line GL1 among the plurality of gate lines GL1~GLm, and the first gate line GL1 may be disposed closest to the gate driving control circuit 500. The first feedback gate signal FGS1 may be a feedback signal of a first gate signal applied to the first gate line GL1 during a first frame period, and the second feedback gate signal FGS2 may be a feedback signal of the first gate signal applied to the first gate line GL1 during a second frame period that is different from the first frame period.

According to exemplary embodiments of the inventive concept, the gate driver 300 may be an amorphous silicon gate (ASG) unit that is integrated in the display panel 100. For example, the gate driver 300 may be disposed in the peripheral region PA of the display panel 100, and may be adjacent to a first side (e.g., a relatively short side on the left) of the display panel 100.

According to exemplary embodiments of the inventive concept, the timing controller 200 and the gate driving control circuit 500 may be mounted on the PCB 250, and the data driver 400 may be mounted on the FPCB 450. The FPCB 450 may electrically connect the PCB 250 with the display panel 100. For example, the PCB 250 and the FPCB 450 may be electrically connected by an anisotropic conductive film (ACF), and the FPCB 450 and the display panel 100 may be electrically connected by the ACE For example, the FPCB 450 may be adjacent to a second side (e.g., a relatively long side on top) of the display panel 100 that crosses the first side of the display panel 100.

Figure 2:
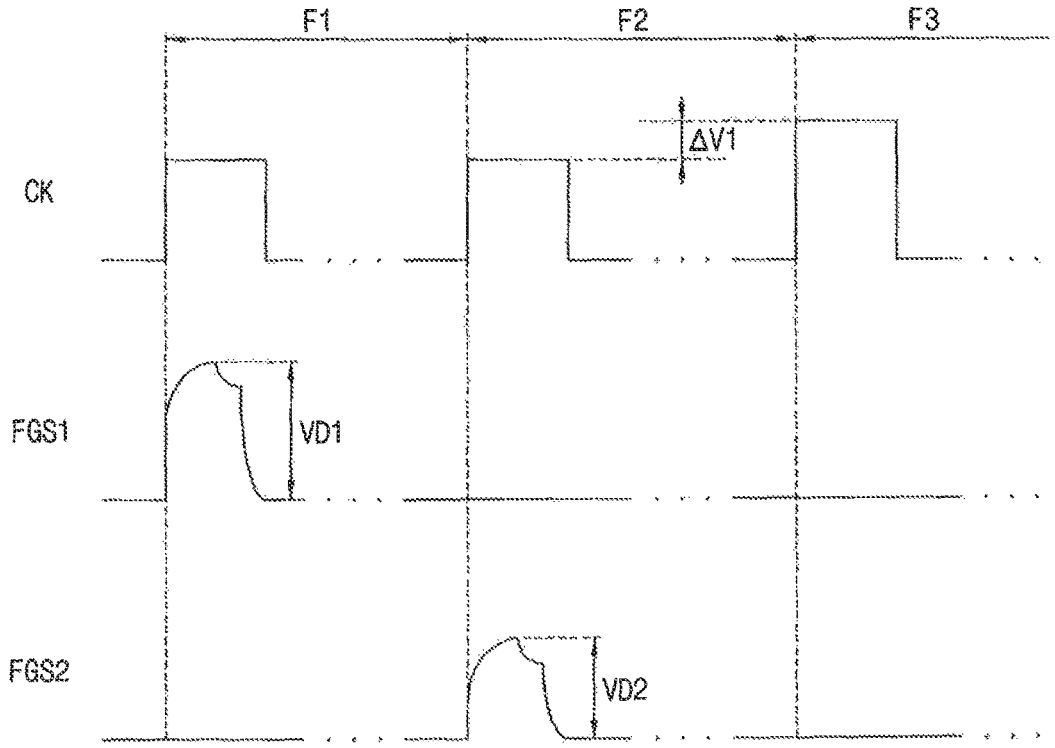
FIGS. 2 and 3 are timing diagrams for describing operations of the display apparatus of FIG. 1 according to an exemplary embodiment of the inventive concept.
Figure 3:
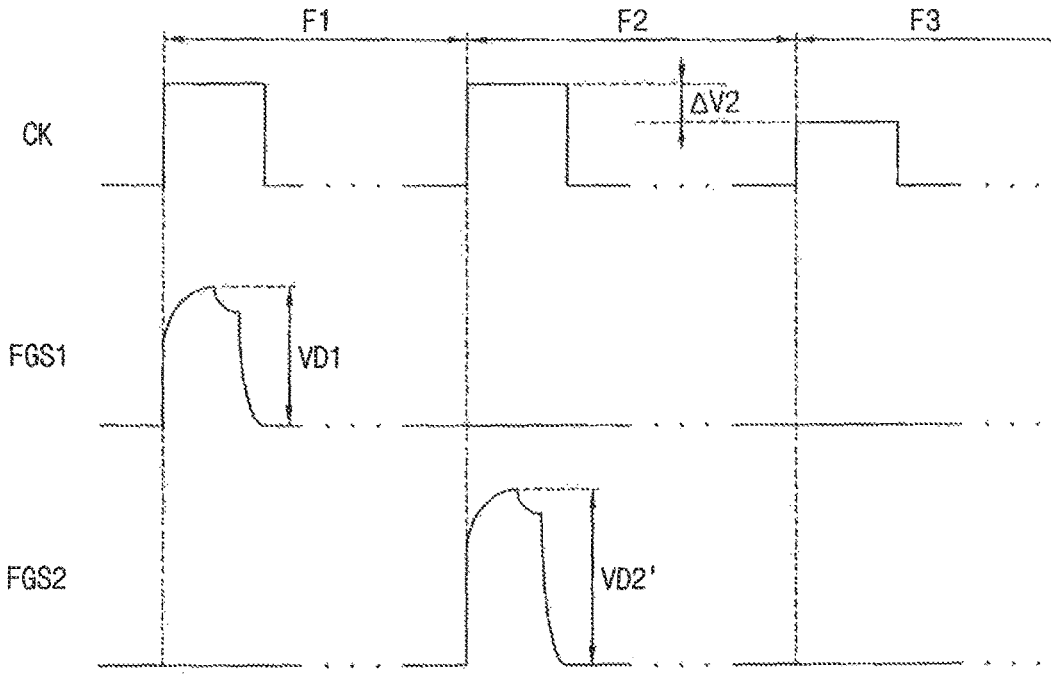

FIGS. 2 and 3 are timing diagrams for describing operations of the display apparatus of FIG. 1 according to an exemplary embodiment of the inventive concept.

Referring to FIGS. 1 and 2, during a first frame period F1 in which the first frame image is displayed on the display panel 100, the gate driving control circuit 500 may receive the first feedback gate signal FGS1 that is retrieved from the first gate line GL1, and may detect a first voltage value VD1 that represents a voltage difference between a high level and a low level of the first feedback gate signal FGS1. The first feedback gate signal FGS1 may be substantially the same as the first gate signal applied to the first gate line GL1 during the first frame period F1.

During a second frame period F2 in which the second frame image is displayed on the display panel 100, the gate driving control circuit 500 may receive the second feedback gate signal FGS2 that is retrieved from the first gate line GL1, and may detect a second voltage value VD2 that represents a voltage difference between a high level and a low level of the second feedback gate signal FGS2. The second feedback gate signal FGS2 may be substantially the same as the first gate signal applied to the first gate line GL1 during the second frame period F2.

When a difference between the first and second voltage values VD1 and VD2 is greater than a reference value (e.g., VR, described below with reference to FIG. 4), the gate driving control circuit 500 may determine that the operation environment of the display apparatus 10 is the abnormal temperature environment, and then may adjust, control, or regulate a high voltage level of the gate clock signal CK in the abnormal temperature environment. For example, when the difference between the first and second voltage values VD1 and VD2 is greater than the reference value, and when the first voltage value VD1 is greater than the second voltage value VD2 (e.g., when a voltage level of a gate signal decreases), the gate driving control circuit 500 may determine that the operation environment is a low temperature environment, and thus, may increase the high voltage level of the gate clock signal CK by ΔV1 during a third frame period F3 in which a third frame image, subsequent to the second frame image, is displayed on the display panel 100. During the third frame period F3, since the high voltage level of the gate clock signal CK increases by ΔV1, a high voltage level of the first gate signal may also increase by ΔV1, and thus, a voltage level change of the first gate signal due to the low temperature environment may be compensated or corrected.

According to exemplary embodiments of the inventive concept, in the low temperature environment, the gate driving control circuit 500 may increase the high voltage level of the gate clock signal CK by the difference between the first and second voltage values VD1 and VD2 (e.g., VD1−VD2=ΔV1). For example, the gate driving control circuit 500 may directly increase the high voltage level of the gate clock signal CK by ΔV1. As another example, the gate driving control circuit 500 may increase a level of the gate on voltage by ΔV1, and may generate the gate clock signal CK having an increased high voltage level based on the increased gate on voltage.

According to exemplary embodiments of the inventive concept, in the low temperature environment, an increment (e.g., ΔV1) of the high voltage level of the gate clock signal CK may be proportional to the difference between the first and second voltage values VD1 and VD2.

The first, second, and third frame images may be a previous frame image, a current frame image, and a next frame image, respectively. According to exemplary embodiments of the inventive concept, the first, second, and third frame images may be consecutive or successive frame images displayed on the display panel 100. For example, when the second frame image is an N-th frame image where N is a natural number, the first frame image may be an (N−1)-th frame image, and the third frame image may be an (N+1)-th frame image. According to exemplary embodiments of the inventive concept, the first and second frame images may not be consecutive or successive frame images. For example, when the second frame image is the N-th frame image, the first frame image may be an (N−K)-th frame image where K is a natural number greater than or equal to two. In this example, the third frame image may be the (N+1)-th frame image.

The operation of comparing a feedback gate signal of the current frame image with a feedback gate signal of the previous frame image may be repeated per a set or predetermined period (e.g., at every frame period).

When the difference between the first and second voltage values VD1 and VD2 is less than or equal to the reference value, the high voltage level of the gate clock signal CK may not be adjusted, and may be maintained.

Referring to FIGS. 1 and 3, an operation of detecting the first voltage value VD1 during the first frame period F1 and an operation of detecting a second voltage value VD2' during the second frame period F2 may be substantially the same as the operations described above with reference to FIG. 2.

Operations of FIG. 3 may be substantially the same as operations of FIG. 2, except that the second voltage value VD2' of FIG. 3 is different from the second voltage value VD2 of FIG. 3, and an adjustment of the gate clock signal CK is changed in FIG. 3.

When a difference between the first and second voltage values VD1 and VD2' is greater than the reference value (e.g., VR in FIG. 4), the gate driving control circuit 500 may determine that the operation environment of the display apparatus 10 is the abnormal temperature environment, and then may adjust, control, or regulate the high voltage level of the gate clock signal CK in the abnormal temperature environment. For example, when the difference between the first and second voltage values VD1 and VD2' is greater than the reference value, and when the first voltage value VD1 is less than the second voltage value VD2' (e.g., when a voltage level of a gate signal increases), the gate driving control circuit 500 may determine that the operation environment is a high temperature environment, and thus, may decrease the high voltage level of the gate clock signal CK by ΔV2 during the third frame period F3. During the third frame period F3, since the high voltage level of the gate clock signal CK decreases by ΔV2, the high voltage level of the first gate signal may also decrease by ΔV2, and thus, a voltage level change of the first gate signal due to the high temperature environment may be compensated or corrected.

According to exemplary embodiments of the inventive concept, in the high temperature environment, the gate driving control circuit 500 may decrease the high voltage level of the gate clock signal CK by the difference between the first and second voltage values VD1 and VD2' (e.g., VD2'−VD1=ΔV2). According to exemplary embodiments of the inventive concept, in the high temperature environment, a decrement (e.g., ΔV2) of the high voltage level of the gate clock signal CK may be proportional to the difference between the first and second voltage values VD1 and VD2'.

In the high temperature environment, the gate driving control circuit 500 may further increase a slew rate of the gate clock signal CK.

FIGS. 2 and 3 illustrate examples where a pulse of each of the feedback gate signals FGS1 and FGS2 has a shape having three segments (e.g., within the first frame period F1), which include a first segment changing from a low level to a high level, a second segment changing from the high level to a middle level, and a third segment changing from the middle level to the low level. However, the inventive concept is not limited thereto, and a pulse of each feedback gate signal may have one of various shapes. For example, a pulse of each feedback gate signal may have a rectangular shape similar to that of the gate clock signal CK.

In addition, a high voltage level of the inverted gate clock signal CKB may also be adjusted.

If a display apparatus operates in the low temperature environment, a voltage level of a gate signal may decrease, and thus, a display defect may occur due to a lack of gate driving capability. If a display apparatus operates in the high temperature environment, a voltage level of a gate signal may increase or a single gate signal may have several pulses during one frame period, and thus, a display defect may occur.

The display apparatus 10 according to exemplary embodiments of the inventive concept may retrieve a gate signal from one of the gate lines GL1~GLm through the feedback line FL, and may determine whether the operation environment of the display apparatus 10 is the normal environment or the abnormal temperature environment based on a comparison result of the first and second feedback gate signals FGS1 and FGS2. In the abnormal temperature environment, the gate driving control circuit 500 included in the display apparatus 10 may adjust the voltage level of the gate clock signal CK in real time. Accordingly, a circuit for compensating the temperature change may be relatively easily and simply implemented without a temperature variable resistor (e.g., a negative temperature coefficient (NTC) thermistor) and/or without setting an initial temperature, and thus, the deterioration of display quality due to the temperature change may be efficiently prevented.

Figure 4:
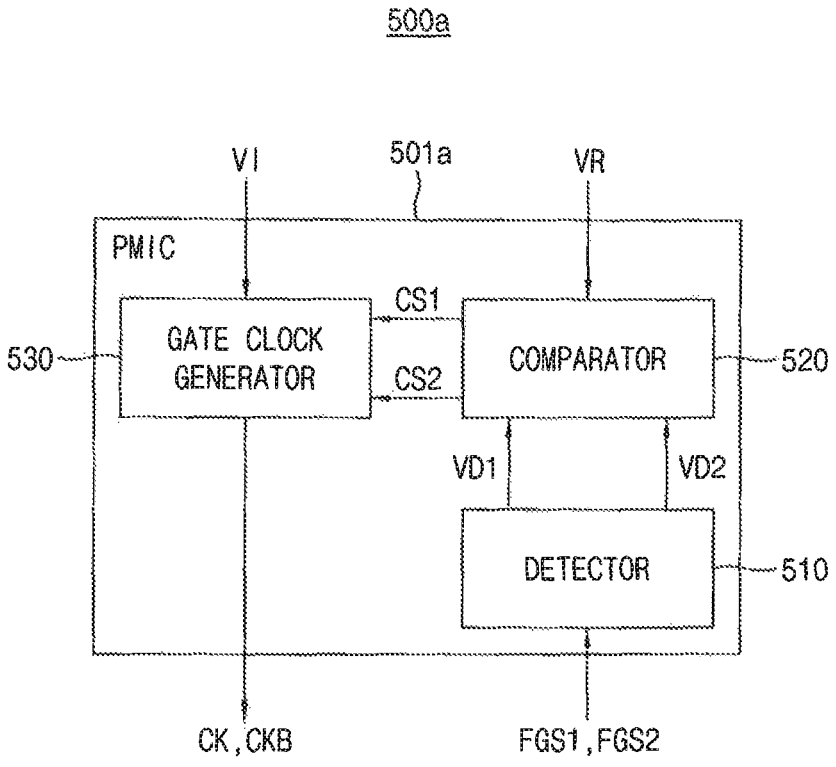
FIG. 4 is a block diagram illustrating a gate driving control circuit included in the display apparatus of FIG. 1 according to an exemplary embodiment of the inventive concept.

FIG. 4 is a block diagram illustrating a gate driving control circuit included in the display apparatus of FIG. 1 according to an exemplary embodiment of the inventive concept.

Referring to FIG. 4, a gate driving control circuit 500*a* may be implemented with a single chip 501*a*, and may include a detector 510, a comparator 520, and a gate clock generator 530. The chip 501*a* may be referred to as a power management integrated circuit (PMIC) chip. The gate driving control circuit 500*a* may correspond to the gate driving control circuit 500 of FIG. 1.

The detector 510 may detect the first and second voltage values VD1 and VD2 from the first and second feedback gate signals FGS1 and FGS2, respectively, and may store the first and second voltage values VD1 and VD2. For example, the detector 510 may include a detecting unit and a storage unit. The detecting unit may detect the first voltage value VD1 from the first feedback gate signal FGS1, and may detect the second voltage value VD2 from the second feedback gate signal FGS2. The storage unit may store the first and second voltage values VD1 and VD2.

According to exemplary embodiments of the inventive concept, the storage unit may store only one voltage value. For example, the storage unit may include a register. The register may store the first voltage value VD1, may output the first voltage value VD1, and then may store the second voltage value VD2. According to exemplary embodiments of the inventive concept, the storage unit may store a plurality of voltage values. For example, the storage unit may include a memory. The memory may substantially simultaneously or concurrently store the first and second voltage values VD1 and VD2.

The comparator 520 may generate a first comparison signal CS1 based on a result of a first comparison, and may generate a second comparison signal CS2 based on a result of a second comparison. The first comparison may represent an operation of comparing a difference between the first and second voltage values VD1 and VD2 with a reference value VR. The second comparison may represent an operation of comparing the first voltage value VD1 with the second voltage value VD2. For example, the first comparison signal CS1 may have a first logic level (e.g., a logic high level) when the difference between the first and second voltage values VD1 and VD2 is greater than the reference value VR, and may have a second logic level (e.g., a logic low level) when the difference between the first and second voltage values VD1 and VD2 is less than or equal to the reference value VR. The second comparison signal CS2 may have the first logic level when the first voltage value VD1 is greater than the second voltage value VD2, and may have the second logic level when the first voltage value VD1 is less than or equal to the second voltage value VD2. According to exemplary embodiments of the inventive concept, the second comparison may be omitted when the first comparison signal CS1 has the second logic level.

The gate clock generator 530 may generate a gate on voltage VON and a gate off voltage VOFF based on the operating voltage VI (described below with reference to FIGS. 5 and 6), and may generate the gate clock signal CK and the inverted gate clock signal CKB based on the gate on voltage VON and the gate off voltage VOFF. When it is determined based on the first and second comparison signals CS1 and CS2 that the operation environment is the abnormal temperature environment, the gate clock generator 530 may adjust the high voltage level of the gate clock signal CK. For example, the gate clock generator 530 may further receive the difference between the first and second voltage values VD1 and VD2, and may increase or decrease the high voltage level of the gate clock signal CK based on the difference between the first and second voltage values VD1 and VD2.

The comparator 520 may be implemented as a lookup table for generating a compensation value based on the first and second voltage values VD1 and VD2, and the gate clock generator 530 may adjust the high voltage level of the gate clock signal CK based on the compensation value.

Figure 5:
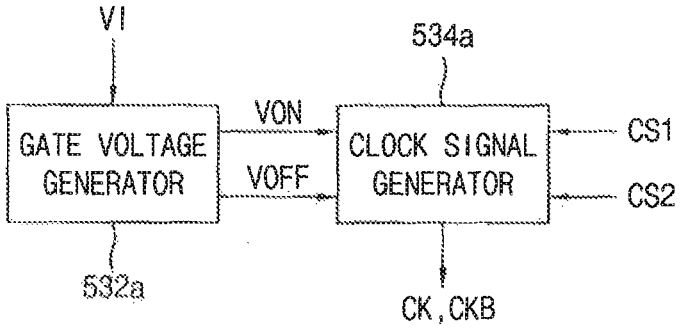
FIGS. 5 and 6 are block diagrams illustrating a gate clock generator included in the gate driving control circuit of FIG. 4 according to exemplary embodiments of the inventive concept.
Figure 6:
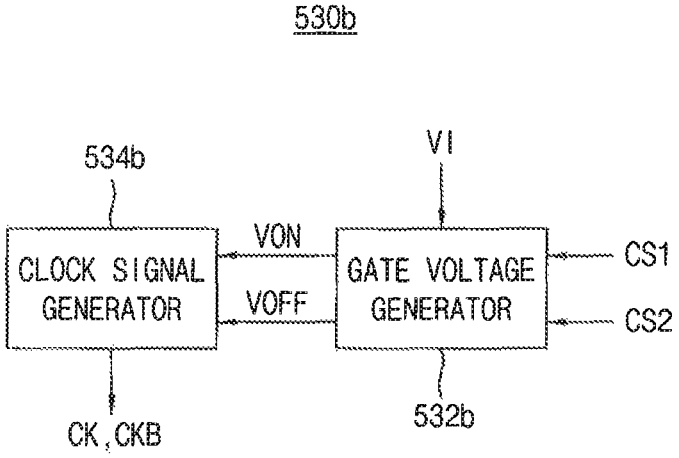

FIGS. 5 and 6 are block diagrams illustrating a gate clock generator included in the gate driving control circuit of FIG. 4 according to exemplary embodiments of the inventive concept.

Referring to FIG. 5, a gate clock generator 530*a* may include a gate voltage generator 532*a* and a clock signal generator 534*a*. The gate clock generator 530*a* may correspond to the gate clock generator 530 of FIG. 4.

The gate voltage generator 532*a* may generate the gate on voltage VON and the gate off voltage VOFF based on the operating voltage VI. The clock signal generator 534*a* may generate the gate clock signal CK and the inverted gate clock signal CKB based on the gate on voltage VON and the gate off voltage VOFF, and may adjust the high voltage level of the gate clock signal CK when it is determined, based on the first and second comparison signals CS1 and CS2, that the operation environment is the abnormal temperature environment. In FIG. 5, a level of the gate on voltage VON may be fixed or maintained, and the high voltage level of the gate clock signal CK may be directly adjusted based on the first and second comparison signals CS1 and CS2 and the difference between the first and second voltage values VD1 and VD2.

Referring to FIG. 6, a gate clock generator 530*b* may include a gate voltage generator 532*b* and a clock signal generator 534*b*. The gate clock generator 530*b* may correspond to the gate clock generator 530 of FIG. 4.

The gate voltage generator 532*b* may generate the gate on voltage VON and the gate off voltage VOFF based on the operating voltage VI, and may adjust the level of the gate on voltage VON when it is determined, based on the first and second comparison signals CS1 and CS2, that the operation environment is the abnormal temperature environment. The clock signal generator 534*b* may generate the gate clock signal CK and the inverted gate clock signal CKB based on the gate on voltage VON and the gate off voltage VOFF. In FIG. 6, the level of the gate on voltage VON may be adjusted based on the first and second comparison signals CS1 and CS2 and the difference between the first and second voltage values VD1 and VD2, and thus, the high voltage level of the gate clock signal CK may be adjusted based on the adjusted gate on voltage VON.

Figure 7:
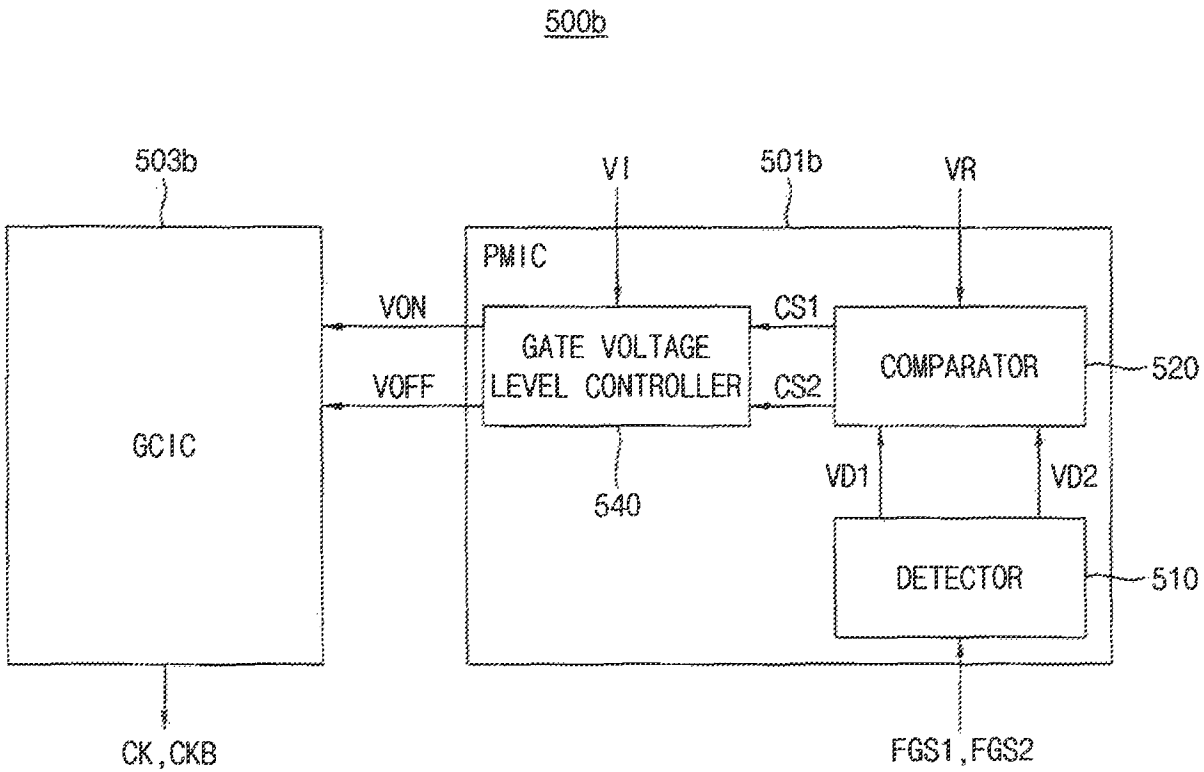
FIGS. 7 and 8 are block diagrams illustrating a gate driving control circuit included in the display apparatus of FIG. 1 according to exemplary embodiments of the inventive concept.
Figure 8:
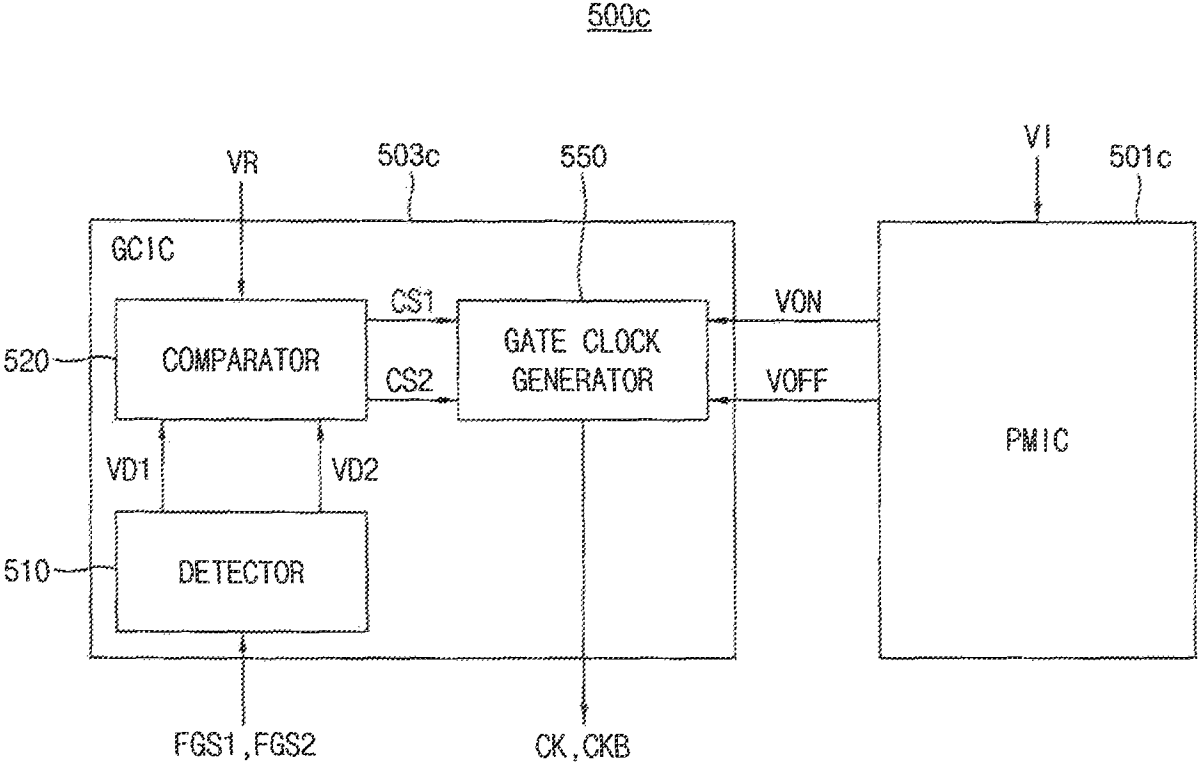

FIGS. 7 and 8 are block diagrams illustrating a gate driving control circuit included in the display apparatus of FIG. 1 according to exemplary embodiments of the inventive concept.

Referring to FIG. 7, a gate driving control circuit 500*b* may be implemented with two chips 501*b* and 503*b*. The chip 501*b* may be referred to as a PMIC chip, and the chip 503*b* may be referred to as a gate clock generation integrated circuit (GCIC) chip. The gate driving control circuit 500*b* may correspond to the gate driving control circuit 500 of FIG. 1.

The PMIC chip 501*b* may generate the gate on voltage VON and the gate off voltage VOFF. The PMIC chip 501*b* may include the detector 510, the comparator 520 and a gate voltage level controller 540.

The gate voltage level controller 540 may generate the gate on voltage VON and the gate off voltage VOFF based on the operating voltage VI, and may adjust the level of the gate on voltage VON when it is determined, based on the first and second comparison signals CS1 and CS2, that the operation environment is the abnormal temperature environment. The gate voltage level controller 540 in FIG. 7 may be substantially the same as the gate voltage generator 532*b* in FIG. 6.

The GCIC chip 503*b* may generate the gate clock signal CK and the inverted gate clock signal CKB based on the gate on voltage VON and the gate off voltage VOFF. The GCIC chip 503*b* in FIG. 7 may be similar to the clock signal generator 534*b* in FIG. 6.

Referring to FIG. 8, a gate driving control circuit 500*c* may be implemented with two chips 501*c* and 503*c*. The chip 501*c* may be referred to as a PMIC chip, and the chip 503*c* may be referred to as a GCIC chip. The gate driving control circuit 500*c* may correspond to the gate driving control circuit 500 of FIG. 1.

The PMIC chip 501*c* may generate the gate on voltage VON and the gate off voltage VOFF based on the operating voltage VI. The PMIC chip 501*c* in FIG. 8 may be similar to the gate voltage generator 532*a* in FIG. 5.

The GCIC chip 503*c* may generate the gate clock signal CK and the inverted gate clock signal CKB based on the gate on voltage VON and the gate off voltage VOFF. The GCIC chip 503*c* may include the detector 510, the comparator 520 and a gate clock generator 550.

The gate clock generator 550 may generate the gate clock signal CK and the inverted gate clock signal CKB based on the gate on voltage VON and the gate off voltage VOFF, and may adjust the high voltage level of the gate clock signal CK when it is determined, based on the first and second comparison signals CS1 and CS2, that the operation environment is the abnormal temperature environment. The gate clock generator 550 in FIG. 8 may be substantially the same as the clock signal generator 534*a* in FIG. 5.

Figure 9:
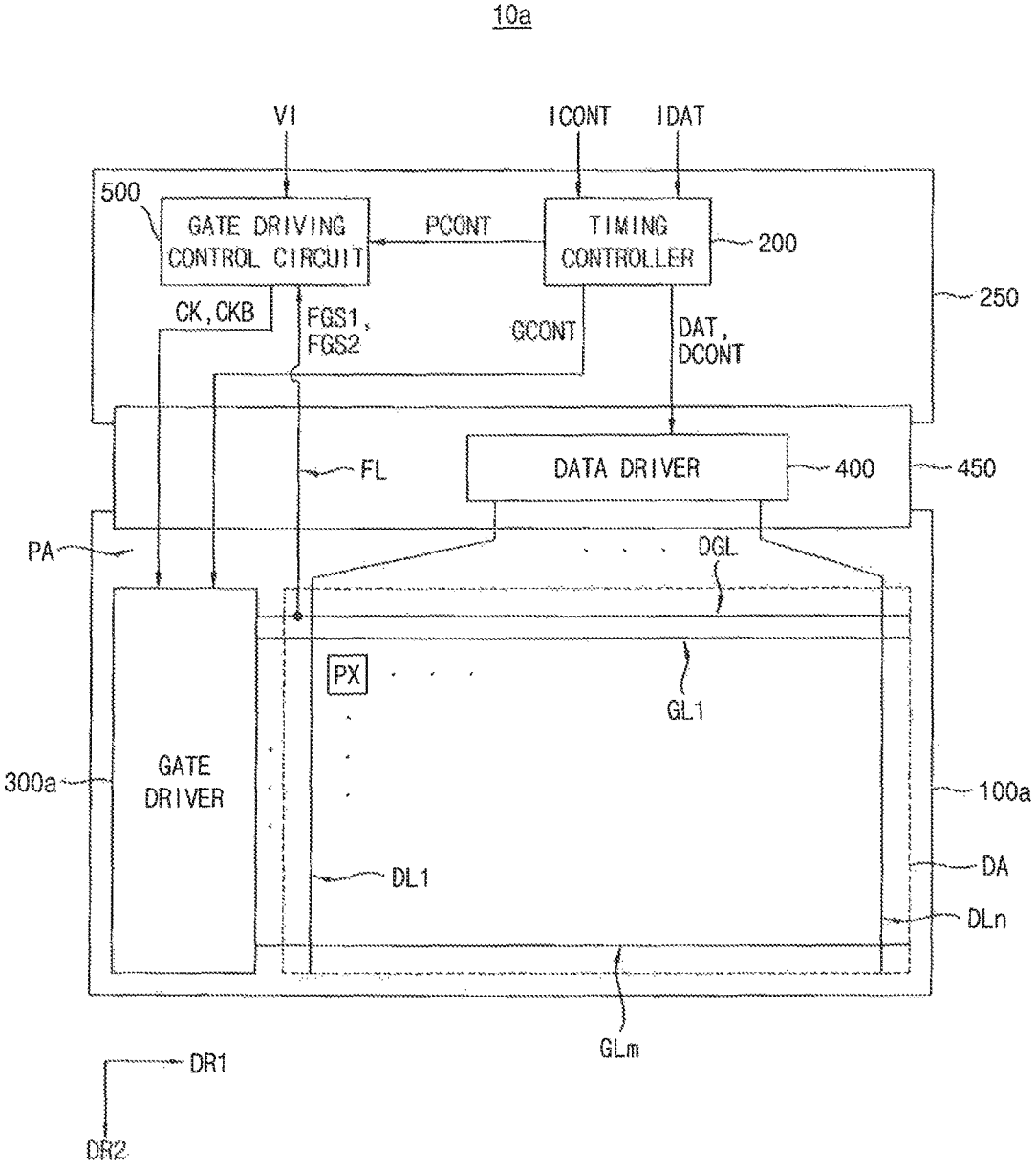
FIG. 9 is a block diagram illustrating a display apparatus according to an exemplary embodiment of the inventive concept.

FIG. 9 is a block diagram illustrating a display apparatus according to an exemplary embodiment of the inventive concept.

Referring to FIG. 9, a display apparatus 10*a* includes a display panel 100*a*, the timing controller 200, a gate driver 300*a*, the data driver 400, and the gate driving control circuit 500. The display apparatus 10*a* may further include the PCB 250 and the FPCB 450.

The display apparatus 10*a* of FIG. 9 may be substantially the same as the display apparatus 10 of FIG. 1, except that the display apparatus 10*a* of FIG. 9 further includes a dummy gate line DGL, and structures of the display panel 100*a*, the gate driver 300*a* and the feedback line FL in FIG. 9 are different from the display panel 100, the gate driver 300, and the feedback line FL in FIG. 1.

The gate driver 300*a* is connected to the display panel 100*a* through the gate lines GL1~GLm and the dummy gate line DGL. The gate driver 300*a* may generate the gate signals, and may sequentially provide the gate signals to the display panel 100*a* through the dummy gate line DGL and the gate lines GL1~GLm.

The gate driving control circuit 500 generates the gate clock signal CK based on the gate on voltage (e.g., VON) and the gate off voltage (e.g., VOFF) that are generated based on the operating voltage VI, determines whether an operation environment of the display apparatus 10*a* is the normal environment or the abnormal temperature environment by comparing the first feedback gate signal FGS1 with the second feedback gate signal FGS2, and adjusts the voltage level of the gate clock signal CK when it is determined that the operation environment is the abnormal temperature environment.

According to exemplary embodiments of the inventive concept, the first and second feedback gate signals FGS1 and FGS2 may be retrieved or returned from the dummy gate line DGL.

Although exemplary embodiments are described with reference to FIGS. 1 through 9 based on examples where the voltage level of the gate clock signal CK is selectively adjusted by comparing the feedback gate signals that are retrieved from a single gate line, the inventive concept is not limited thereto. For example, feedback gate signals may be retrieved from several (e.g., two or more) gate lines.

Although exemplary embodiments are described with reference to FIGS. 1 through 9 based on examples where the gate driving control circuit 500 generates a single gate clock signal CK, the inventive concept is not limited thereto. For example, the gate driving control circuit may generate a plurality of gate clock signals and a plurality of inverted gate clock signals. In this example, a phase of one of the gate clock signals may partially overlap phases of other gate clock signals such that the display apparatus operates based on a dual gate clock driving scheme, a quadruple gate clock driving scheme, or the like.

Although exemplary embodiments are described with reference to FIGS. 2 through 8 based on examples where the gate signal is compensated in the abnormal temperature environment by adjusting the level of the gate on voltage VON and/or the high voltage level of the gate clock signal CK, the gate signal may instead be compensated by adjusting a level of the gate off voltage VOFF and/or a low voltage level of the gate clock signal CK, or by adjusting both the levels of the gate on voltage VON and the gate off voltage VOFF and/or both the high and low voltage levels of the gate clock signal CK.

Although exemplary embodiments are described with reference to FIGS. 2 through 8 based on examples where the abnormal temperature environment is detected by monitoring the voltage level of the gate signal, the abnormal temperature environment may also be detected by monitoring a ripple level of the gate signal, or by monitoring both the voltage level and the ripple level of the gate signal.

Although exemplary embodiments are described with reference to FIGS. 1 and 9 based on examples where the gate driving control circuit 500 is disposed on a top side of the display panel 100 or 100*a* and retrieves the gate signal from an uppermost gate line (e.g., GL1 or DGL), the gate driving control circuit may instead be disposed under a bottom side of the display panel and may retrieve a gate signal from a lowermost gate line (e.g., GLm). Although FIGS. 1 and 9 illustrate examples where the gate driver 300 or 300*a* is an ASG unit, the gate driver may be disposed at any location included in the display apparatus.

Although FIGS. 1 and 9 illustrate examples where the timing controller 200, the gate driving control circuit 500, and the data driver 400 are mounted on different circuit boards (e.g., PCB 250 and FPCB 450), the timing controller, the gate driving control circuit, and the data driver may be mounted on the same circuit board. Although FIGS. 1 and 9 illustrate examples where the display apparatus 10 or 10*a* includes a single data driver chip mounted on a single FPCB 450, the display apparatus may include a plurality of data driver chips. In this example, the number of the FPCBs on which at least one data driver chip is mounted may be less than or equal to the number of data driver chips.

Figure 10:
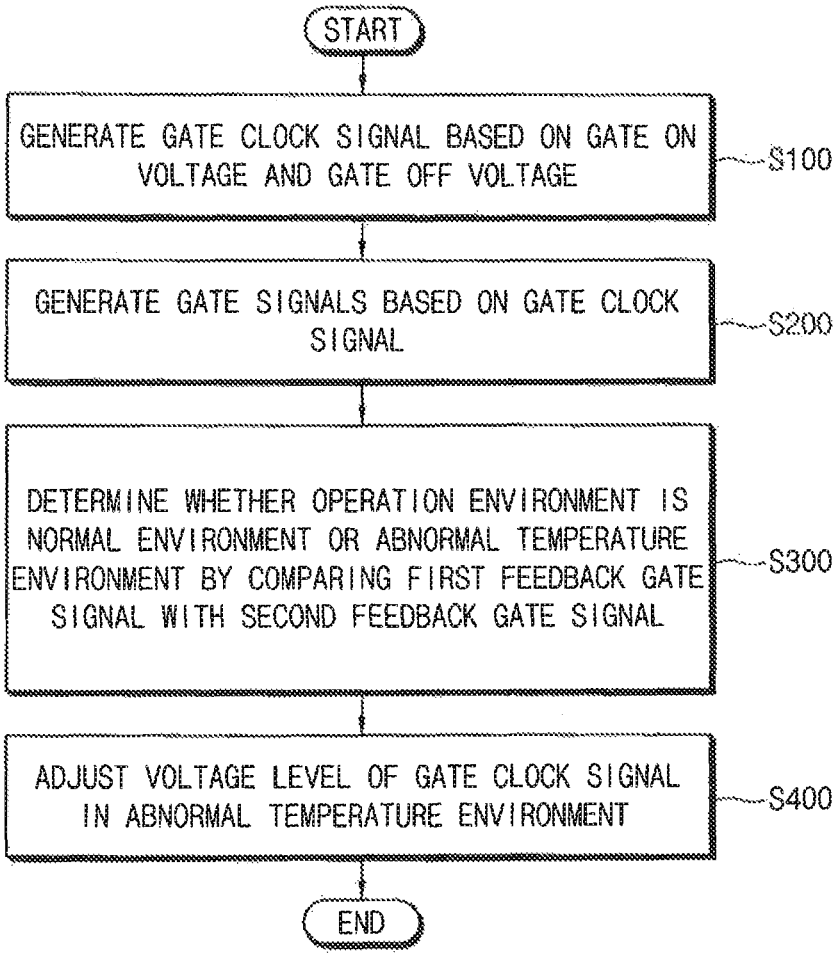
FIG. 10 is a flowchart illustrating a method of operating a display apparatus according to an exemplary embodiment of the inventive concept.

FIG. 10 is a flowchart illustrating a method of operating a display apparatus according to an exemplary embodiment of the inventive concept.

Referring to FIGS. 1 and 10, in a method of operating the display apparatus 10 according to exemplary embodiments of the inventive concept, the gate clock signal CK is generated based on the gate on voltage (e.g., VON in FIG. 5) and the gate off voltage (e.g., VOFF in FIG. 5) that are generated based on the operating voltage VI (operation S100). The plurality of gate signals for driving the display panel 100 are generated based on the gate clock signal CK (operation S200).

It is determined whether the operation environment of the display apparatus 10 is the normal environment or the abnormal temperature environment by comparing the first feedback gate signal FGS1 with the second feedback gate signal FGS2 (operation S300). The first feedback gate signal FGS1 is retrieved from the display panel 100 while the first frame image is displayed on the display panel 100. The second feedback gate signal FGS2 is retrieved from the display panel 100 while the second frame image, subsequent to the first frame image, is displayed on the display panel 100. The feedback line FL for retrieving the first and second feedback gate signals FGS1 and FGS2 may be connected to one of the gate lines GL1~GLm or the dummy gate line (e.g., DGL in FIG. 9). For example, the feedback line FL may be connected to a gate line (e.g., GL1 or DGL) that is disposed closest to the gate driving control circuit 500.

The voltage level of the gate clock signal CK is adjusted when it is determined that the operation environment is the abnormal temperature environment (operation S400).

According to exemplary embodiments of the inventive concept, operations S100, S300, and S400 may be performed by the gate driving control circuit 500, and operation S200 may be performed by the gate driver 300.

According to exemplary embodiments of the inventive concept, the gate driving control circuit 500 may be implemented with a single chip as illustrated in FIG. 4, or may be implemented with two chips as illustrated in FIGS. 7 and 8.

Figure 11:
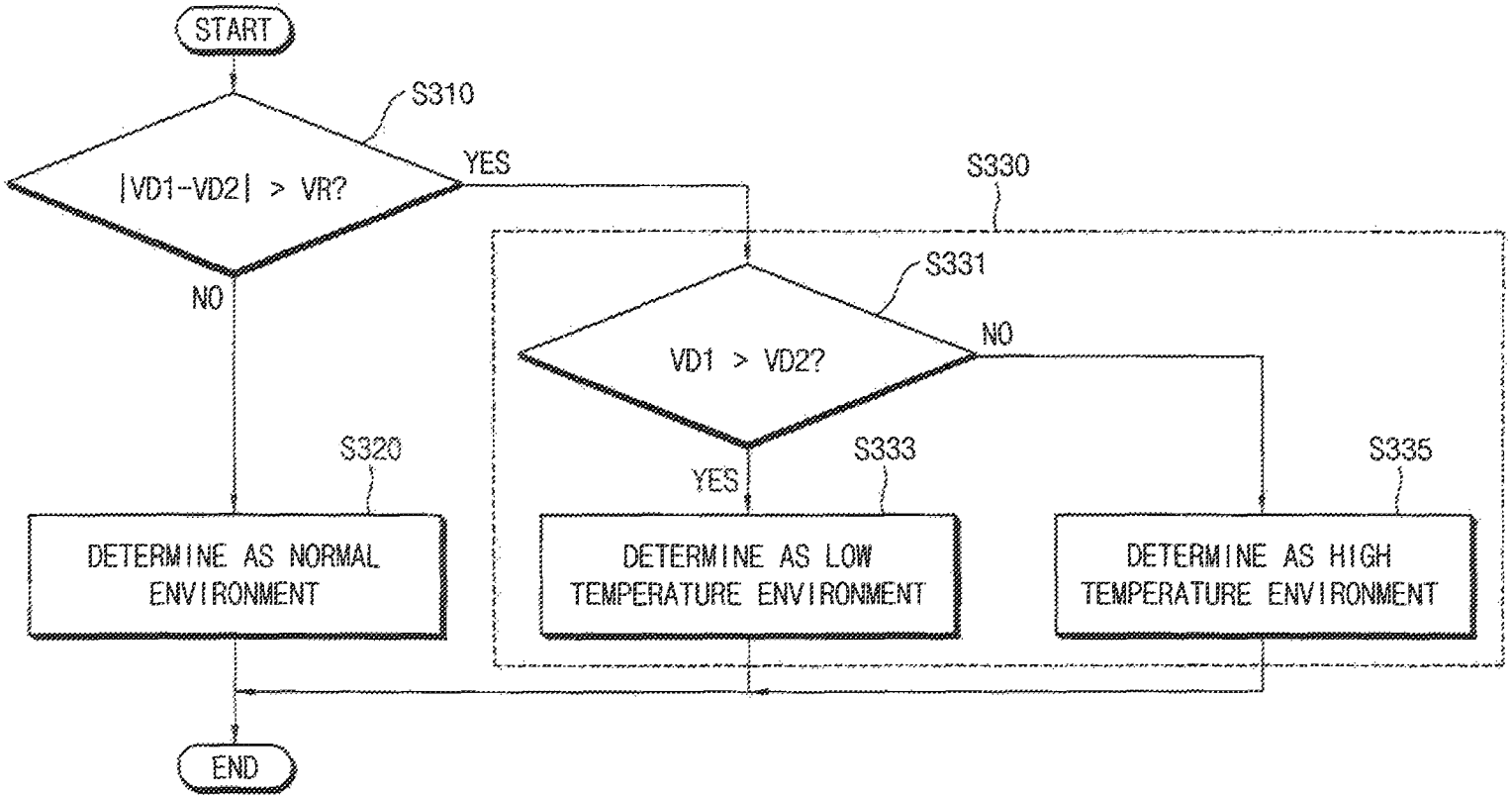
FIG. 11 is a flowchart illustrating an operation of FIG. 10 to determine whether an operation environment is a normal environment or an abnormal temperature environment according to an exemplary embodiment of the inventive concept.

FIG. 11 is a flowchart illustrating an operation of FIG. 10 to determine whether an operation environment is a normal environment or an abnormal temperature environment according to an exemplary embodiment of the inventive concept.

Referring to FIGS. 1, 10, and 11, in operation S300, the first voltage value VD1 may be compared with the second voltage value VD2 (operation S310). The first voltage value VD1 may represent the voltage difference between a high level and a low level of the first feedback gate signal FGS1. The second voltage value VD2 may represent the voltage difference between a high level and a low level of the second feedback gate signal FGS2.

When the difference between the first and second voltage values VD1 and VD2 is greater than the reference value VR (operation S310: YES), it may be determined that the operation environment of the display apparatus 10 is the abnormal temperature environment (operation S330).

For example, as illustrated in FIG. 2, when the difference between the first and second voltage values VD1 and VD2 is greater than the reference value VR (operation S310: YES), and when the first voltage value VD1 is greater than the second voltage value VD2 (operation S331: YES), it may be determined that the operation environment is the low temperature environment (operation S333). As illustrated in FIG. 3, when the difference between the first and second voltage values VD1 and VD2' is greater than the reference value VR (operation S310: YES), and when the first voltage value VD1 is less than or equal to the second voltage value VD2' (operation S331: NO), it may be determined that the operation environment is the high temperature environment (operation S335).

When the difference between the first and second voltage values VD1 and VD2 is less than or equal to the reference value VR (operation S310: NO), it may be determined that the operation environment is the normal environment (operation S320).

According to exemplary embodiments of the inventive concept, operations S310, S320, and S330 may be performed by the gate driving control circuit 500.

Figure 12:
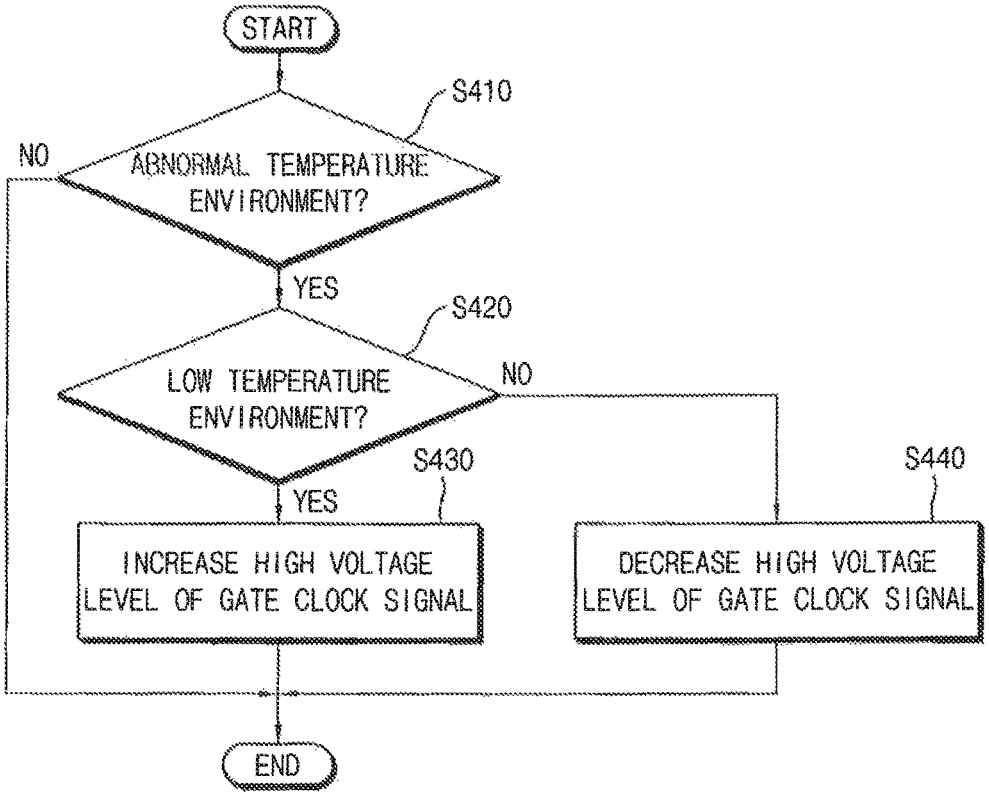
FIG. 12 is a flowchart illustrating an operation of FIG. 10 of adjusting a voltage level of a gate clock signal according to an exemplary embodiment of the inventive concept.

FIG. 12 is a flowchart illustrating an operation in FIG. 10 of adjusting a voltage level of a gate clock signal according to an exemplary embodiment of the inventive concept.

Referring to FIGS. 1, 10, and 12, in operation S400, when it is determined that the operation environment is the low temperature environment (operation S410: YES and operation S420: YES), the high voltage level of the gate clock signal CK may be increased (operation S430). For example, as illustrated in FIG. 2, the high voltage level of the gate clock signal CK may increase by the difference between the first and second voltage values VD1 and VD2. According to exemplary embodiments of the inventive concept, the high voltage level of the gate clock signal CK may be directly increased, or may increase based on the gate on voltage VON that has been increased.

When it is determined that the operation environment is the high temperature environment (operation S410: YES and operation S420: NO), the high voltage level of the gate clock signal CK may be decreased (operation S440). For example, as illustrated in FIG. 3, the high voltage level of the gate clock signal CK may decrease by the difference between the first and second voltage values VD1 and VD2'.

When it is determined that the operation environment is the normal environment (operation S410: NO), the high voltage level of the gate clock signal CK may not be adjusted, and may be maintained.

According to exemplary embodiments of the inventive concept, operations S410, S420, S430, and S440 may be performed by the gate driving control circuit 500.

The inventive concept may be embodied as a system, method, computer program product, and/or a computer program product stored in one or more computer readable medium(s) having computer readable program code. The computer readable program code may be provided to a processor of a general purpose computer, special purpose computer, or other programmable data processing apparatus. The computer readable medium may be a computer readable signal medium or a computer readable storage medium. The computer readable storage medium may be any tangible medium that can contain or store a program for use by or in connection with an instruction execution system, apparatus, or device. For example, the computer readable medium may be a non-transitory computer readable medium.

The above described exemplary embodiments may be used in a display apparatus and/or a system including the display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, etc.

As described above, in the display apparatus according to exemplary embodiments of the inventive concept, feedback gate signals may be retrieved from one of the gate lines through the feedback line, and it may be determined whether the operation environment of the display apparatus is the normal environment or the abnormal temperature environment based on a comparison result of the feedback gate signals. In the abnormal temperature environment, the gate driving control circuit included in the display apparatus may adjust the voltage level of the gate clock signal in real time. Accordingly, a circuit for compensating the temperature change may be relatively easily and simply implemented without a temperature variable resistor and/or without setting an initial temperature, and thus, the deterioration of display quality due to temperature change may be efficiently prevented.

While the inventive concept has been shown and described with reference to exemplary embodiments thereof, it will be apparent to those of ordinary skill in the art that various modifications in form and details may be made thereto without materially departing from the spirit and scope of the inventive concept as defined by the following claims.

What is claimed is:

1. A display apparatus comprising:

a display panel;

a gate driver circuit connected to the display panel, and configured to generate a plurality of gate signals for driving the display panel using a gate clock signal; and a gate driving control circuit configured to generate the gate clock signal using a gate on voltage and a gate off voltage, configured to determine whether an operation environment is a normal environment or an abnormal temperature environment by comparing a first feedback gate signal with a second feedback gate signal, and configured to adjust a voltage level of the gate clock signal when it is determined that the operation environment is the abnormal temperature environment, wherein the first feedback gate signal is retrieved from the display panel while a first frame image is displayed on the display panel, and the second feedback gate signal is retrieved from the display panel while a second frame image subsequent to the first frame image is displayed on the display panel.

2. The display apparatus of claim 1, wherein the gate driving control circuit is configured to:

compare a first voltage value with a second voltage value; and determine that the operation environment is the abnormal temperature environment when a difference between the first and second voltage values is greater than a reference value, and wherein the first voltage value is a voltage difference between a high level and a low level of the first feedback gate signal, and the second voltage value is a voltage difference between a high level and a low level of the second feedback gate signal.

3. The display apparatus of claim 2, wherein the gate driving control circuit is configured to:

determine that the abnormal temperature environment is a low temperature environment when the first voltage value is greater than the second voltage value; and increase a high voltage level of the gate clock signal in the low temperature environment.

4. The display apparatus of claim 3, wherein, in the low temperature environment, the gate driving control circuit is configured to increase the high voltage level of the gate clock signal by the difference between the first and second voltage values.

5. The display apparatus of claim 3, wherein, in the low temperature environment, the gate driving control circuit is configured to:

increase a level of the gate on voltage by the difference between the first and second voltage values; and increase the high voltage level of the gate clock signal using the increased gate on voltage.

6. The display apparatus of claim 2, wherein the gate driving control circuit is configured to:

determine that the abnormal temperature environment is a high temperature environment when the first voltage value is less than equal to the second voltage value; and decrease a high voltage level of the gate clock signal in the high temperature environment.

7. The display apparatus of claim 2, wherein the gate driving control circuit comprises:

a detector circuit configured to detect the first and second voltage values from the first and second feedback gate signals, respectively, and configured to store the first and second voltage values;

a comparator circuit configured to generate a first comparison signal by comparing the difference between the first and second voltage values with the reference value, and configured to generate a second comparison signal by comparing the first voltage value with the second voltage value; and a gate clock generator circuit configured to generate the gate clock signal using the gate on voltage and the gate off voltage, and configured to adjust a high voltage level of the gate clock signal when it is determined, using the first and second comparison signals, that the operation environment is the abnormal temperature environment, and wherein the detector circuit, the comparator circuit, and the gate clock generator circuit are included in a single chip.

8. The display apparatus of claim 2, wherein the gate driving control circuit comprises:

a power management integrated circuit (PMIC) chip configured to generate the gate on voltage and the gate off voltage; and a gate dock generation integrated circuit (GCIC) chip configured to generate the gate clock signal using the gate on voltage and the gate off voltage, wherein the PMIC chip comprises:

a detector configured to detect the first and second voltage values from the first and second feedback gate signals, respectively, and configured to store the first and second voltage values;

a comparator configured to generate a first comparison signal by comparing the difference between the first and second voltage values with the reference value, and configured to generate a second comparison signal by comparing the first voltage value with the second voltage value; and a gate voltage level controller configured to generate the gate on voltage and the gate off voltage, and configured to adjust a level of the gate on voltage when it is determined, using the first and second comparison signals, that the operation environment is the abnormal temperature environment.

9. The display apparatus of claim 2, wherein the gate driving control circuit comprises:

a PMIC chip configured to generate the gate on voltage and the gate off voltage; and a GCIC chip configured to generate the gate clock signal using the gate on voltage and the gate off voltage, wherein the GCIC chip comprises:

a detector configured to detect the first and second voltage values from the first and second feedback gate signals, respectively, and configured to store the first and second voltage values;

a comparator configured to generate a first comparison signal by comparing the difference between the first and second voltage values with the reference value, and configured to generate a second comparison signal by comparing the first voltage value with the second voltage value; and a gate clock generator configured to generate the gate clock signal using the gate on voltage and the gate off voltage, and configured to adjust a high voltage level of the gate clock signal when it is determined, using the first and second comparison signals, that the operation environment is the abnormal temperature environment.

10. The display apparatus of claim 1, further comprising:

a plurality of gate lines connecting the display panel with the gate driver circuit, wherein the first and second feedback gate signals are retrieved from one of the plurality of gate lines.

11. The display apparatus of claim 10, wherein the first and second feedback gate signals are retrieved from a first gate line among the plurality of gate lines, and among the plurality of gate lines, the first gate line is disposed closest to the gate driving control circuit.

12. The display apparatus of claim 10, further comprising:

a feedback line connecting the gate driving control circuit with a first gate line among the plurality of gate lines, wherein the first and second feedback gate signals are retrieved from the first gate line.

13. The display apparatus of claim 1, further comprising;

a plurality of gate lines and a dummy gate line connecting the display panel with the gate driver circuit, wherein the first and second feedback gate signals are retrieved from the dummy gate line.

14. The display apparatus of claim 1, wherein the first and second frame images are two consecutive frame images displayed on the display panel.

15. The display apparatus of claim 1, wherein the display panel comprises a display region including a plurality of pixels and a peripheral region surrounding the display region, and wherein the gate driver circuit is disposed on the peripheral region of the display panel.

16. A method of operating a display apparatus including a display panel, the method comprising:

generating a gate clock signal using a gate on voltage and a gate off voltage;

generating a plurality of gate signals for driving the display panel using the gate clock signal;

determining whether an operation environment is a normal environment or an abnormal temperature environment by comparing a first feedback gate signal with a second feedback gate signal, wherein the first feedback gate signal is retrieved from the display panel while a first frame image is displayed on the display panel and the second feedback gate signal is retrieved from the display panel while a second frame image subsequent to the first frame image is displayed on the display panel; and adjusting a voltage level of the gate clock signal when it is determined that the operation environment is the abnormal temperature environment.

17. The method of claim 16, wherein determining whether the operation environment is the normal environment or the abnormal temperature environment comprises:

comparing a first voltage value with a second voltage value, wherein the first voltage value is a voltage difference between a high level and a low level of the first feedback gate signal and the second voltage value is a voltage difference between a high level and a low level of the second feedback gate signal; and determining that the operation environment is the abnormal temperature environment when a difference between the first and second voltage values is greater than a reference value.

18. The method of claim 17, wherein determining that the operation environment is the abnormal temperature environment comprises:

determining that the abnormal temperature environment is a low temperature environment when the first voltage value is greater than the second voltage value; and determining that the abnormal temperature environment is a high temperature environment when the first voltage value is less than or equal to the second voltage value.

19. The method of claim 18, wherein adjusting the voltage level of the gate clock signal comprises:

increasing a high voltage level of the gate clock signal in the low temperature environment; and decreasing the high voltage level of the gate clock signal in the high temperature environment.

20. A display apparatus comprising:

a display panel;

a gate driver circuit connected to the display panel, and configured to provide a plurality of gate signals for driving the display panel to a plurality of gate lines using a gate clock signal;

a gate driving control circuit connected to the gate driver circuit and configured to provide the gate clock signal to the gate driver circuit; and a feedback line connected between the gate driving control circuit and a first gate line among the plurality of gate lines, and configured to provide a first feedback gate signal and a second feedback gate signal from the first gate line to the gate driving control circuit, wherein the first feedback gate signal is a feedback signal of a first gate signal applied to the first gate line while a first frame image is displayed on the display panel, the second feedback gate signal is a feedback signal of the first gate signal applied to the first gate line while a second frame image subsequent to the first frame image is displayed on the display panel, and the gate driving control circuit is configured to receive the first feedback gate signal and the second feedback gate signal from the feedback line, to compare the first feedback gate signal with the second feedback gate signal to generate a comparison result, and to adjust a voltage level of the gate clock signal depending on the comparison result of the first and second feedback gate signals.

* * * * *